US005550616A

United States Patent [19]

Fukushima

[11] Patent Number: 5,550,616

[45] Date of Patent: Aug. 27, 1996

[54] IMAGE FORMING APPARATUS INCLUDING MEANS FOR CONTROLLING IMAGE FORMING CONDITION IN ACCORDANCE WITH AMBIENT CONDITION AND PATCH DENSITY DETECTION

[75] Inventor: Hisashi Fukushima, Kawasaki, Japan

[73] Assignee: Canon Kabushiki Kaisha, Tokyo, Japan

[21] Appl. No.: 337,383

[22] Filed: Nov. 8, 1994

[30] Foreign Application Priority Data

Nov. 8, 1993 [JP] Japan ..... 5-300775

[51] Int. Cl.[6] ..... G03G 21/00

[52] U.S. Cl. ..... 355/208; 355/203

[58] Field of Search ..... 355/208, 203, 355/204, 246, 219, 210, 285

[56] References Cited

U.S. PATENT DOCUMENTS

| | | | |
|---|---|---|---|
| 5,038,175 | 8/1991 | Sohmiya et al. | 355/246 |
| 5,146,274 | 9/1992 | Hattori et al. | 355/208 |
| 5,148,218 | 9/1992 | Nakane et al. | 355/208 |
| 5,225,872 | 7/1993 | Fukushima . | |
| 5,253,018 | 10/1993 | Takeuchi et al. | 355/246 |
| 5,276,483 | 1/1994 | Hasegawa et al. | 355/208 |
| 5,294,959 | 3/1994 | Nagao, et al. . | |
| 5,327,209 | 7/1994 | Sasanuma et al. . | |
| 5,400,120 | 3/1995 | Narazaki et al. | 355/208 |

FOREIGN PATENT DOCUMENTS 1-319054 12/1989 Japan .

*Primary Examiner*—Sandra L. Brase

*Attorney, Agent, or Firm*—Fitzpatrick, Cella, Harper & Scinto

[57] ABSTRACT

An image forming apparatus includes a toner image forming device for forming a toner image on a recording material an ambient condition detector for detecting an ambient condition: a controller for controlling an image forming condition of the image forming device on the basis of an output of the ambient condition detector; and a second detector for detecting a parameter relating to a toner charge amount of the toner image; wherein the controller is capable of controlling the image forming condition on the basis of an output of the second detector when a main power source of the apparatus is changed from an off-state to an on-state.

28 Claims, 10 Drawing Sheets

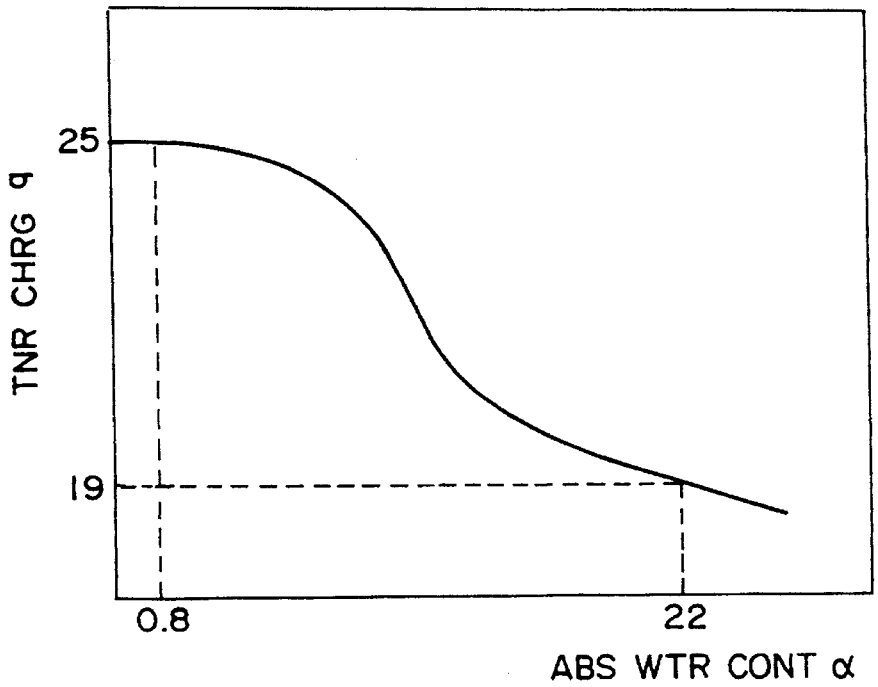
FIG. 6
FIG. 7(a)
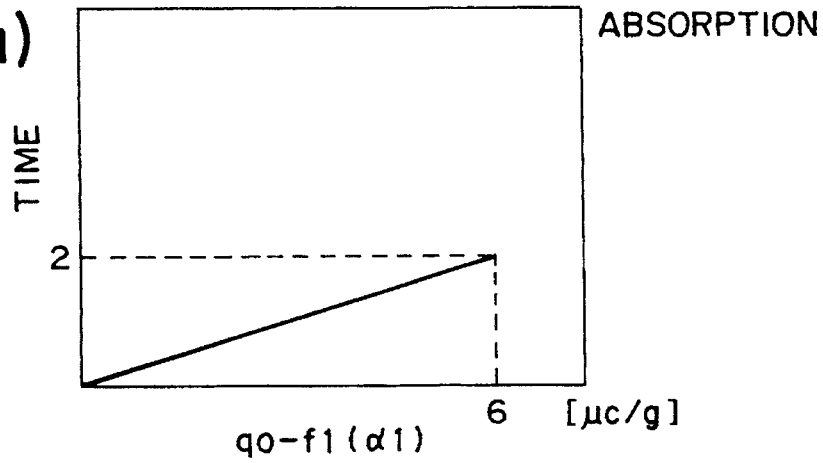
FIG. 7(b)
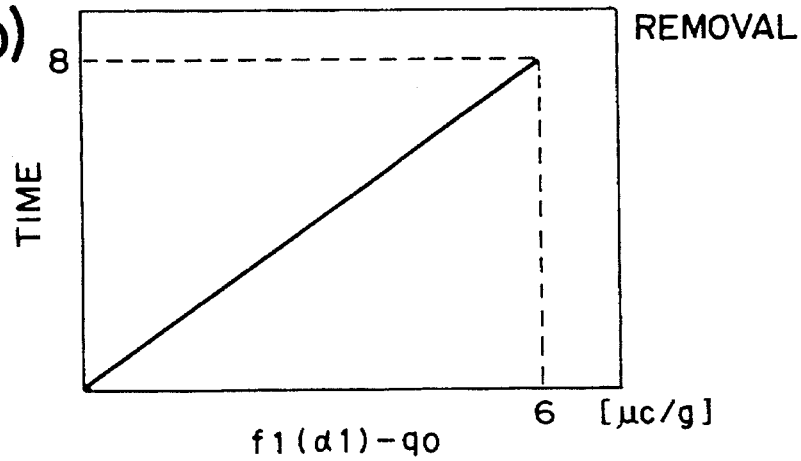

IMAGE FORMING APPARATUS INCLUDING MEANS FOR CONTROLLING IMAGE FORMING CONDITION IN ACCORDANCE WITH AMBIENT CONDITION AND PATCH DENSITY DETECTION

FIELD OF THE INVENTION AND RELATED ART

The present invention relates to an image forming apparatus such as a copying machine, a laser beam printer or the like, of an electrophotographic or electrostatic recording type.

In an image forming apparatus of an electrophotographic type, for example, in order to maintain constant image density, a charge potential of the photosensitive drum as the image bearing member and a developing bias voltage applied to the developing device, or the like are controlled, by which the developing contrast potential or fog preventing potential or another image forming condition, are controlled. Particularly, in a color image forming apparatus for forming a full-color image or multi-color image, the image forming conditions are controlled in accordance with the properties of the respective color developers, thus providing uniform image density for the colors.

However, in such a conventional color image forming apparatus, control of the image forming conditions for the respective colors of the developers are carried out, but variation of the image density occurs due to ambient condition changes under which the developer is placed. Particularly, a change of the image density in response to the change of the humidity is remarkable, Additionally, the rate of density change due to moisture absorption is different if the developer is different, with the result of remarkable density difference.

Japanese Laid-Open Patent Application No. 319054/1989, which has been assigned to the assignees of this application, proposes an image forming apparatus provided with ambient condition detecting means, in response to which the image forming conditions are controlled in accordance with the output of the detecting means.

In this Laid-Open Application, in order to compensate for time difference between the detected moisture and the moisture content of the developer, the history of the detected moisture is stored, and the current moisture content of the developer is predicted or estimated.

However, in the prior art, the history data of the detected moisture is required, and therefore, the estimation is not satisfactorily reliable when the humidity detection is started upon actuation of a main switch. This is because there is no history data of the moisture when the main switch is off. Therefore, the image forming conditions are not optimized, resulting in of instable image forming operations.

It would be considered as a countermeasure that an auxiliary power source is provided to maintain the humidity sensor in the on-state, and a temperature detection data accumulation circuit is maintained in the on-state independently of the main switch. However, the structure of such an apparatus is complicated and expensive, and there is no guarantee of power e.g., when the plug is disconnected from the electric power outlet. In place of the detection of the ambient condition (humidity), a toner sticker (patch) may be formed on the photosensitive drum to detect the moisture content in the developer, in real time, but the toner sticker formation for each input of the image formation start signal results in longer time period requirements for the first print.

SUMMARY OF THE INVENTION

Accordingly, it is a principal object of the present invention to provide an image forming apparatus in which stabilized image quality is always assured irrespective of variation of the ambient condition.

It is another object of the present invention to provide an inexpensive image forming apparatus.

It is a further object of the present invention to provide an image forming apparatus in which satisfactory images are produced without using variation data of the ambient condition when the main switch of the apparatus is maintained off.

It is a yet a further object of the present invention to provide an image forming apparatus in which the time required for the first print is reduced.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIG. 6 is a graph of a table for the same calculation.

FIGS. 7(*a*) and 7(*b*) are tables used in the same calculation.

DESCRIPTION OF THE PREFERRED EMBODIMENTS

Figure 1A:
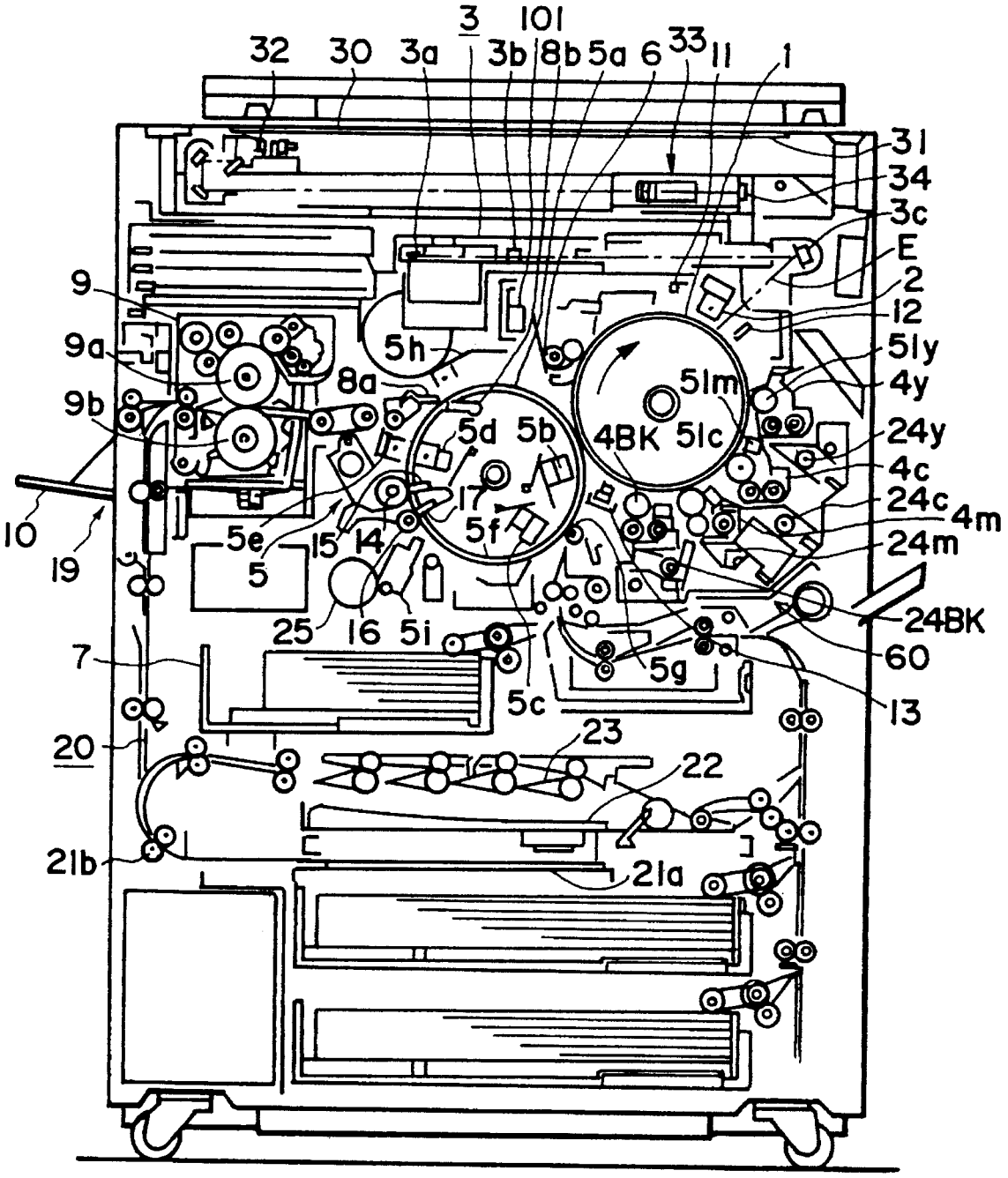
FIG. 1A is a sectional view of an image forming apparatus according to an embodiment of the present invention.
Figure 1B:
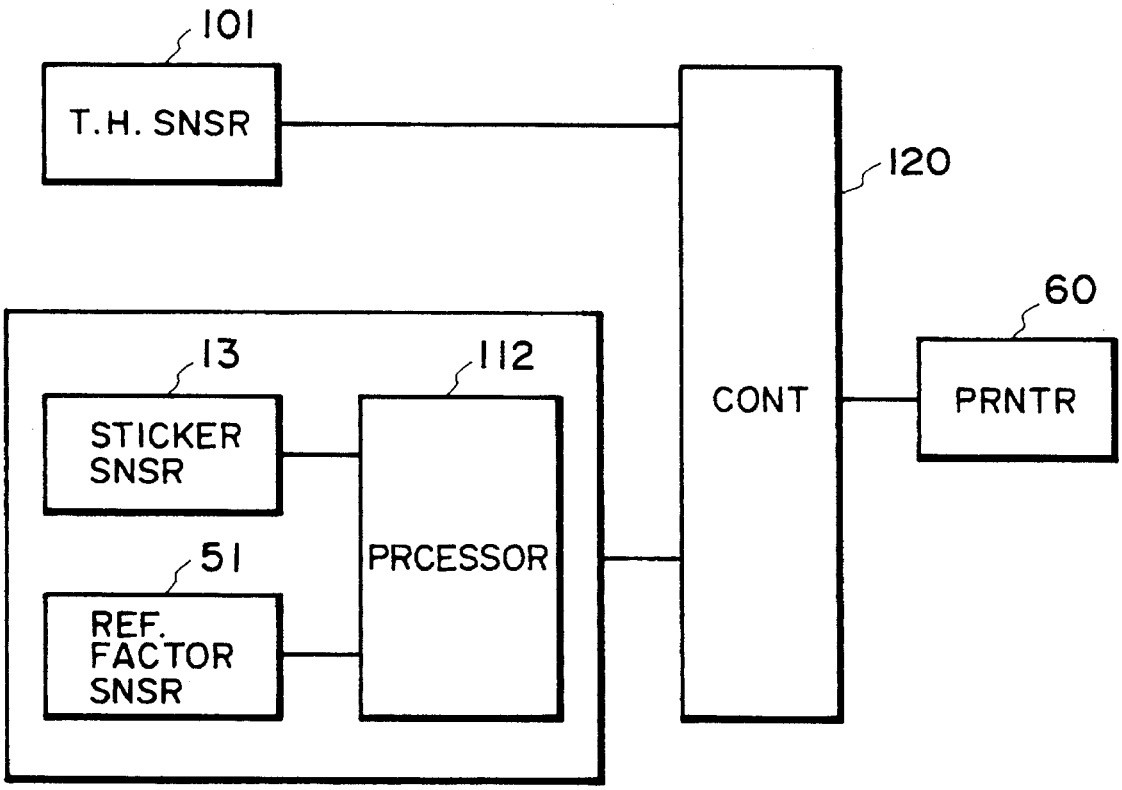
FIG. 1B is a block diagram of the apparatus.

Referring to FIG. 1, there is shown a color electrophotographic printer as an exemplary image forming apparatus according to an embodiment of the present invention.

The printer comprises a digital color image reader at the top and a digital color image printer at the bottom.

In the reader, an original 30 is placed on an original platen glass 31, and image exposure scanning is effected with an exposure lamp 32, by which a reflected image from the original 30 is converged by a lens 33 onto a full-color sensor 34, by which color separated image signals are produced.

The color separation image signals are processed by an unshown video processing unit through an amplifying circuit not shown, and the processed signals are supplied to the printer 60.

In the printer 60, a photosensitive drum 1 as the image bearing member is rotatable in the direction indicated by an arrow. Around the photosensitive drum 1, there are provided a pre-exposure lamp 11, a corona charger 2, a laser exposure optical system 3, a potential sensor 12, developing devices 4*y*, 4*c*, 4*m*, 4Bk as the developing means for the different colors, detecting means 13 for detecting light quantity on the drum, a transfer device 5 and cleaning device 6.

In the laser exposure optical system 3, the image signal from the reader is converted to light signals by a laser output portion (not shown) and the converted laser beam is reflected by a polygonal mirror 3*a*, and is projected onto the surface of the photosensitive drum 1 through a lens 3*b* and mirror 3*c*.

During image formation of the printer 60, the photosensitive drum 1 is rotated in the direction indicated by an arrow, during which the photosensitive drum 1 having been discharged by the pre-exposure lamp 11 is uniformly charged by the charger 2. The light image E is applied for the respective colors to form a latent image.

Subsequently, a predetermined developing device is operated to develop a latent image on the photosensitive drum 1 to form an image of toner comprising resin materials as a main component, on the photosensitive drum 1. The developing devices 4*y*, 4*c*, 4*m*, 4Bk are selectively moved toward the photosensitive drum 1 in accordance with the colors by operation of eccentric cams 24*y*, 24*c*, 24*m* and 24Bk. In this embodiment, a reverse development is used in which the toner is deposited on the light portion of the latent image, and the toner is charged to the same polarity as the charging polarity of the charger 2.

The toner image on the photosensitive drum 1 is transferred onto a recording material supplied to the position opposed to the photosensitive drum 1 through the sheet feeding system and the transfer device 5 from a cassette of the recording material. The transfer device 5 in this embodiment comprises a transfer drum 5*a*, a transfer charger 5*b*, an attraction charger 5*c* for electrostatic attraction of the recording material, an attraction roller 5*g* opposed to the attraction charger 5*c*, an inside charger 5*d* and an outside charger 5*e*. A peripheral opening of the transfer drum 5*a* supported for rotation is covered with a cylindrical recording material carrying sheet 5*f* of a dielectric material. The recording material carrying sheet 5*f* is of dielectric sheet made of polycarbonate film or the like.

With the rotation of the transfer drum 5*a*, the toner image is transferred onto a recording material carried on the recording material carrying sheet 5*f* by a transfer charger 5*b* from the photosensitive drum 1.

Onto the recording material on the recording material carrying sheet 5*f*, a predetermined number of color images are transferred so that a full-color image is formed.

In case of full-color image formation, the four color toner image transfers are completed, and the recording material is separated from the transfer drum 5*a* by operations of a separation claw 8*a*, a separation assisting roller 8*b* and a separation charger 5*h*, and the recording material is discharged onto a tray 10 through a heat roller fixing device 9 comprising an upper roller 9*a* and a lower roller 9*b*.

On the other hand, the photosensitive drum 1 after the transfer is cleaned by a cleaning device 6 to remove the residual toner from the surface thereof to prepare for a subsequent image forming operation.

When an image is formed on both sides of the recording material, the recording material after being discharged from the fixing device 9 is fed to a reversing path 21*a* through a feeding path 20 by operations of a feeding path switching guide 19. Then by reversing rotation of a reversing roller 21*b*, the recording material fed back is fed to an intermediate tray 22. Again, a image is formed on the opposite side through the above-described image forming process.

In order to prevent deposition of oil on the recording material and scattering of the powdery material onto the recording material carrying sheet 5*f* of the transfer drum 5*a*, the cleaning operation is carried out with the use of a fur brush and and a back-up brush 15 opposed to the brush 14 with the recording material carrying sheet 5*f* therebetween, and an oil removing roller 16 and a back-up brush 17 opposed to the roller 16 with the recording material carrying sheet 5*f* therebetween. The cleaning operation is carried out before or after the image forming operation, and is carried out as desired upon occurrence of sheet jam.

In this embodiment, the eccentric cam 25 is operated at desired timing to operate a cam follower 5*i* integral with the transfer drum 5*a*, so that the gap between the recording material carrying sheet 5*a* and the photosensitive drum 1 is adjustable.

For example, during the stand-by period or power-off period, the gap is formed between the transfer drum 5*a* and the photosensitive drum 1.

Designated by a reference numeral 101 is a temperature and humidity sensor functioning as an ambient detecting means, and is actuated or deactuated in synchronism with actuation or deactuation of the main switch of the printer 60. In other words, when the main switch is in the off-state, sensor 101 is also in the off-sate.

In this embodiment, the image forming condition to be controlled includes a grid bias voltage of a charger 2 in the form of a scorotron and a developing bias voltages (DC) to be applied to the developing devices 4*y*–4Bk. They are determined in accordance with a development contrast which is an input of the potential control (a difference between a light portion potential of the latent image on the photosensitive member and a developing bias voltage). It is desirable that during the developing operation a voltage in the form of a DC biased AC voltage is applied on the developing sleeve. An optimum development contrast is determined on the basis of an estimation of toner triboelectric charge (an amount of charge per unit weight of the toner) which varies with ambient conditions.

The toner triboelectric charge is determined on the basis of the following.

(1) When the main switch is actuated (off-on), a patch is formed; image density of the patch is detected by a patch sensor 13 as an density reading means; and calculation is carried out using processing means 112 on the basis of the detected density to estimate or predict the toner triboelectric charge amount.

(2) On the basis of a direction of change of the absolute humidity of the ambient surrounding thereafter and the changing speed thereafter, the estimated toner triboelectric charge is renewed by control image 120.

The toner charge estimating means 110 is constituted by the patch sensor 13 and the processing means 112.

The sequential operation will be described in detail.

When the main switch is actuated (from off-state to on-state), the upper and lower rollers 9*a* and 9*b* are heated by a heater to a stand-by temperature 170° C. at which temperature the preparation for the image forming operation is completed. Here, when the main switch is actuated and when the upper and lower rollers 9a and 9b of the fixing device 9 are at a predetermined temperature (110° C. for example), a predetermined halftone level toner patch is developed on the photosensitive drum 1 with a predetermined development contrast (S1-1), and a reflection light quantity from the toner is read by light quantity detecting means (patch sensor) 13 for detecting the light quantity from the photosensitive drum, as the density reading means (S1-2).

The toner patch may be formed and the density thereof may be read each time the main switch is actuated. However, when the off period of the main switch is short, as in the case of clearance of a jammed sheet, the data of the temperature and humidity before the main switch deactuation may be read without reading the density of the toner patch, upon the actuation of the main switch after the jam clearance. Therefore, it is preferable that when the fixing temperature is a predetermined level or lower, the toner patch density is detected, and when the fixing temperature is higher than a predetermined level, the toner patch formation or detection is not carried out.

Figure 2:
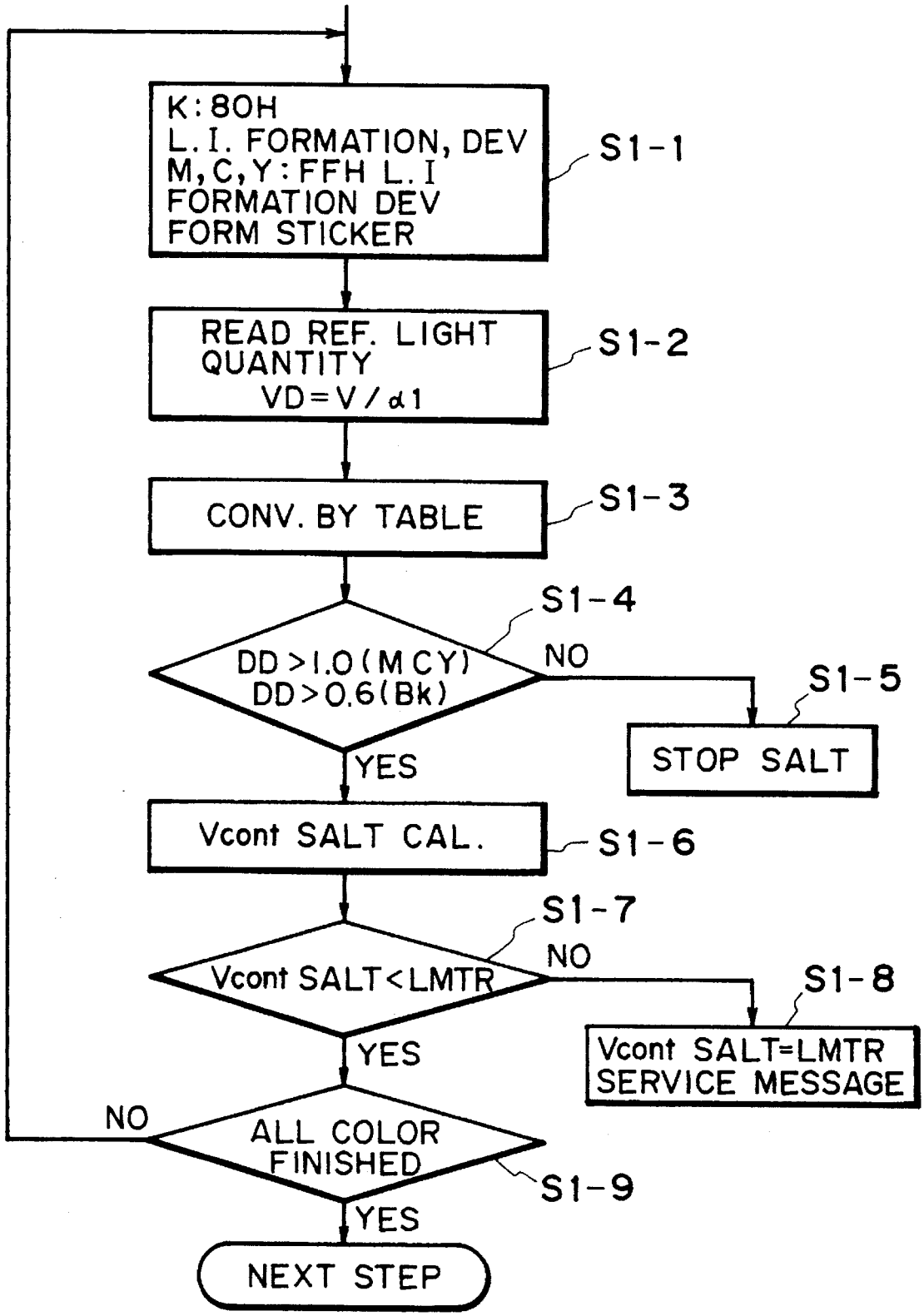
FIG. 2 is a flow chart for initial measurement of the ambient condition in the apparatus.

Then, the initial measurement of the ambient conditions is carried out in accordance with the flow chart shown in FIG. 2. Here, the level of the patch density is expressed by hexadecimal numbers, i.e., 256 tone levels from 0 to FFH (from white to solid black) for M, C, Y and 0–80 H (128 tone levels) for Bk.

$\alpha 1$ is a coefficient representing the deterioration with time in the patch detection sensor 13, and is used to convert the direct output V of the patch sensor 13 to a corrected output VD.

The corrected output VD is converted to a density level using a table (DD) (S1-3). If it is lower than a predetermined level (S1-4), a malfunction of the image forming apparatus is determined to stop the series of density control operation (SALT) (S1-5). When the density level is higher than a predetermined level (S1-4), the normal state is determined, and the initial optimum contrast voltage (VcontSALT) is determined on the basis of the density level (S1-6). At this time, it is confirmed that VcontSALT is smaller than a predetermined limit (S1-7). A service message is produced if VcontSALT exceeds the predetermined limit (S1-8).

The series of operations is carried out for all colors, and upon completion thereof for all colors (S1-9), the next step is carried out.

Figure 9:
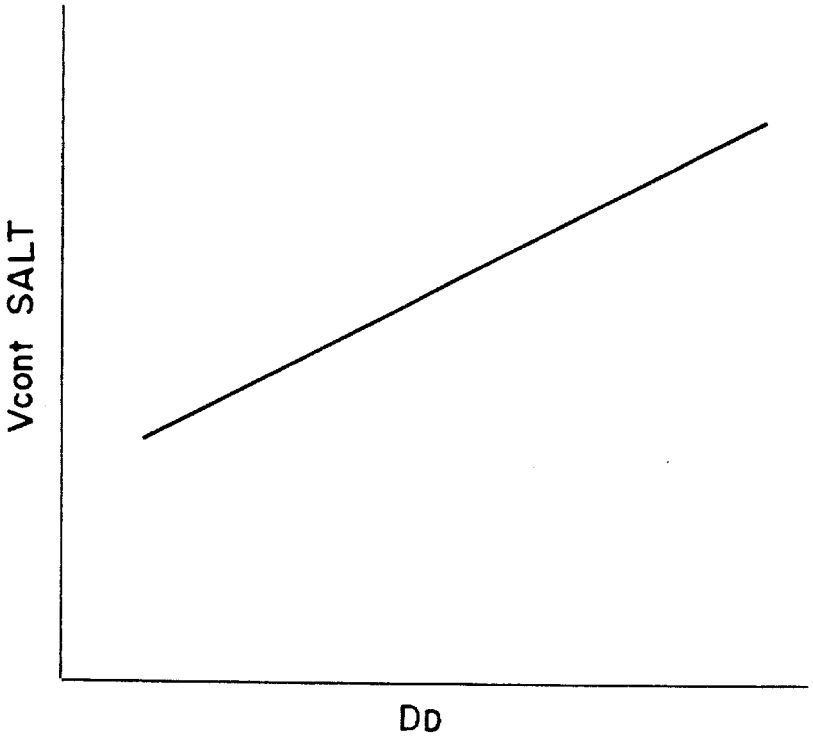
FIG. 9 is a graph of a table used in the same calculation.

FIG. 9 schematically shows an example of a table for determining VcontSALT on the basis of DD. In this figure, only one relation is shown. By providing dependent tables for the respective colors, more accurate control is possible.

Calculation equations will be described.

Figure 8:
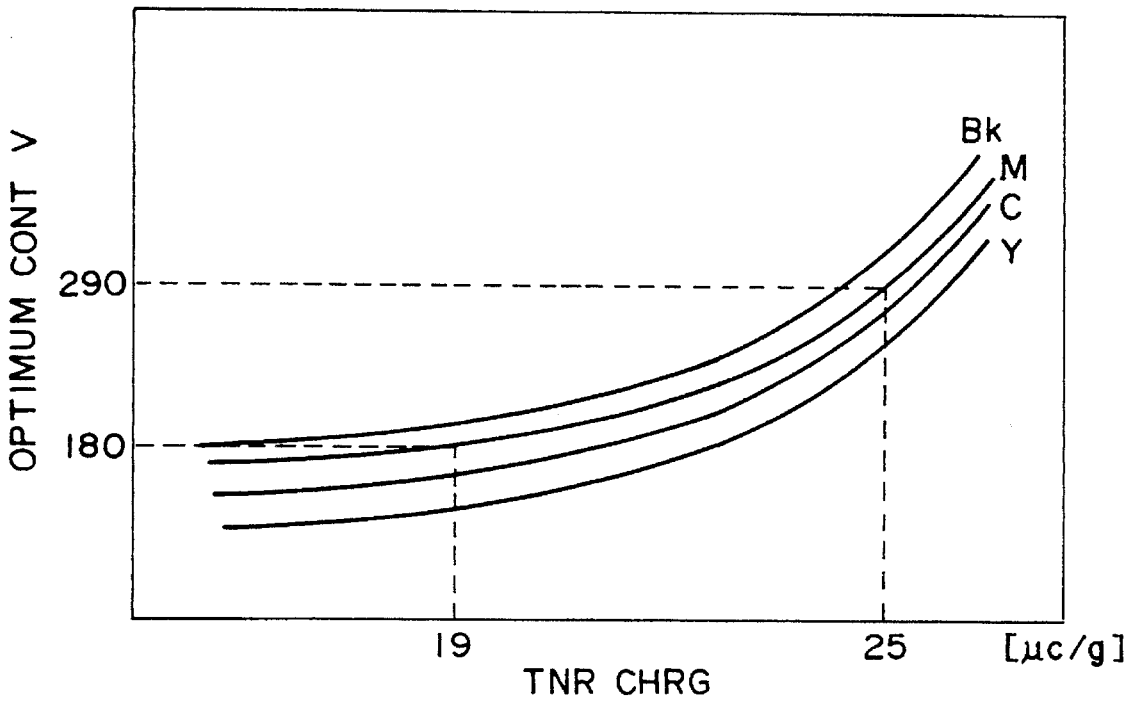
FIG. 8 is a graph of a table used in the same calculation.

FIG. 8 shows a dependency of the optimum contrast voltage (VcontSALT) on the toner charge.

Figure 3:
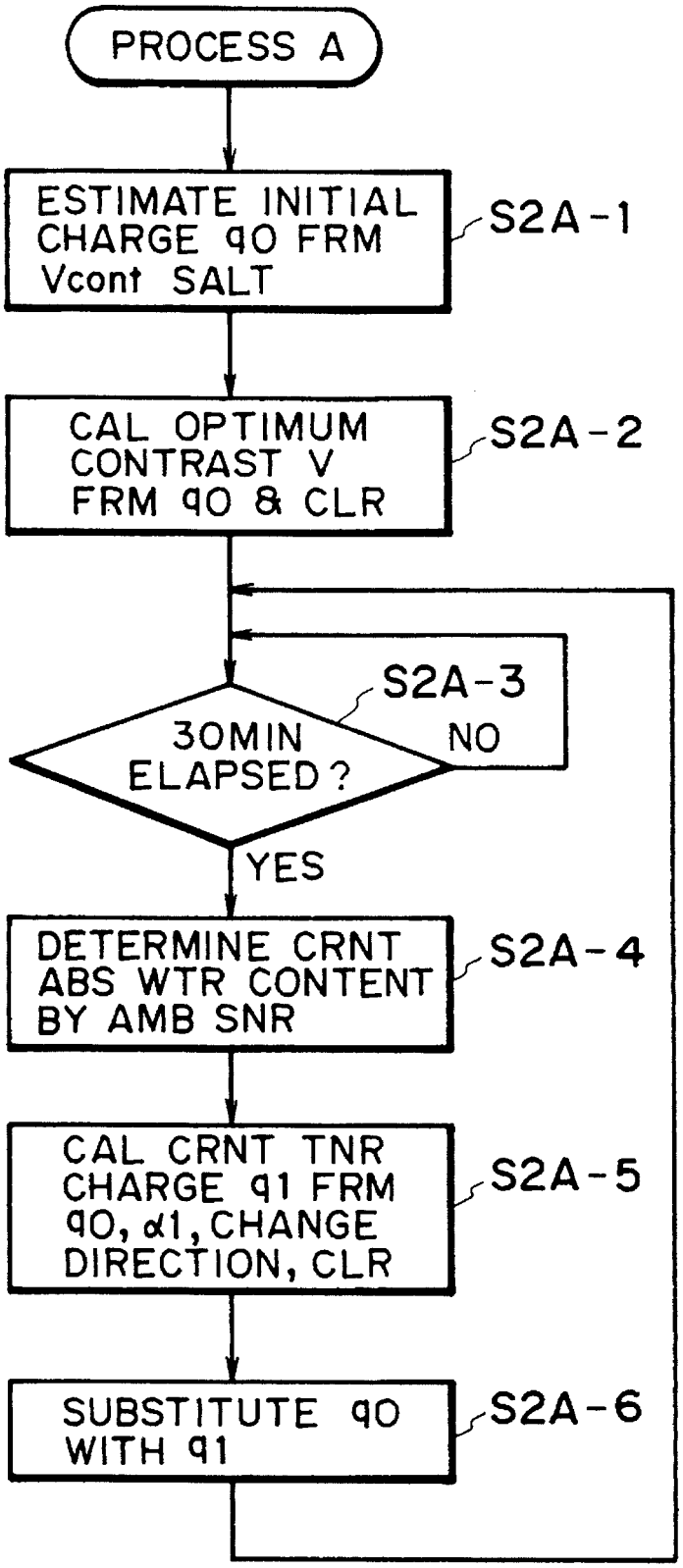
FIG. 3 is a flow chart of process A for calculation of the optimum contrast voltage in the apparatus.

At step S2A-1 of the flow chart 2 in FIG. 3, the toner charge is determined from VcontSALT using the relation shown in FIG. 8.

FIG. 6 shows toner charge q(μC/g) when the toner contains a predetermined moisture or water.

The relationship is expressed as $$q=f1(\alpha),\ \alpha=f1^{-1}(q)$$

where q is toner charge and is moisture content.

The toner charge q1 after 30 minutes elapses from the initial state is estimated using the current humidity $\alpha 1$ obtained at step S2A-4, toner charge q0 30 minutes before and a converging time period T0 from $\alpha 0$ ($=f1^{-1}$ (q0) to $\alpha 1$ moisture state (S2A-5).

The calculation equation is divided depending on whether it is in the moisture increasing state ($\alpha 1 \geqq f1^{-1}$ (q0)) or in the moisture decreasing state ($\alpha 1 \leqq f1^{-1}$ (q0)). More particularly, the time constant used in the calculation is changed depending on that state.

Using the graph of FIG. 7, the converging period T0 from $\alpha 0$ moisture state to $\alpha 1$ moisture state is shown.

(1) Moisture increasing state ($\alpha_1 \geqq f1^{-1}$ (q0)).

The converging period T0 is determined using FIG. 7(*a*), thus determining the following equation:

$$q1=[\{q0-f1(\alpha 1)\}/T0^2]\times(0.5-T0)^2+f1(\alpha 1) \quad (1)$$

where when 0.5>T0, q1=f1($\alpha 1$).

(2) Moisture decreasing case ($\alpha 1 \leqq f1^{=1}$ (q0))

The converging period T0 is determined using FIG. 7(*b*), thus providing the following equation:

$$q1=[\{q0-f1(\alpha 1)\}/T0^2]\times(0.5-T0)^2+f1(\alpha 1) \quad (2)$$

where when 0.5>T0. q1=f1($\alpha 1$)).

In this manner, the toner moisture or water content is calculated for every 30 minutes, thus estimating the water content in the toner.

On the basis of the current water content, the optimum contrast voltage is determined on the basis of FIG. 8.

The above equations will be described. From VcontSALT after actuation of the main switch, the toner charge amount q0 at that time is determined.

The absolute humidity of the ambience under which the triboelectric charge amount q0 is reached when the moisture absorbing state is maintained, is $\alpha 0=(f1^{-1}(q0))$.

FIG. 7 will be described.

Case 1: When toner having a triboelectric charge 25 (μC/g) (23.5° C. and 5%) is suddenly placed under the H/H (30° C., 80%) state, the time required for converging to the charge amount 19 (μC/g), which is the charge under the H/H condition, is 2 hours.

Case 2: When toner having a triboelectric charge amount 19 (μC/g) (30° C. and 80%) is suddenly placed under the N/L (23° C., 5%) condition, the time required for converging to charge to 25 (μC/g) under the N/L condition, is 8 hours.

(1) As a typical example in the case of moisture absorption, the charge after 0.5 hour is estimated or predicted in accordance with the flow chart (case 1), by which equation (3) is obtained $$q=[(25-19)/2^2](t-2)^2+19=3/2\times(t-2)^2+19 \quad (3)$$

q0=25, f1($\alpha 1$)=19, T0=2, where $\alpha 1$ is the absolute humidity under 30° C. and 80%.

The currents charge amount q1 is obtained by t=0.5 in the above equation, thus providing:

$$q1-22.375 \quad (4)$$

(2) As a typical example of a moisture decreasing case, the triboelectric charge amount is estimated or predicted after 0.5 hour in accordance with the flow chart (equation (5)).

$$q=[(19-25)/8^2](t-8)^2+25=(-6/64)\times(t-8)^2+25 \quad (5)$$

q0=19, f1($\alpha 1$)=25, T0=8, where $\alpha 1$ is an absolute humidity under 23° C. 5%.

The current charge q1 is obtained from equation (5) by t=0.5 thus the following is provided:

$$q1=-(\%_{64})\times 7.5^2+25=19.7 \quad (6)$$

In the foregoing description, the toner triboelectric charge amount is used as a toner property corresponding to the optimum contrast voltage, but the toner moisture content is usable.

Figure 12A:
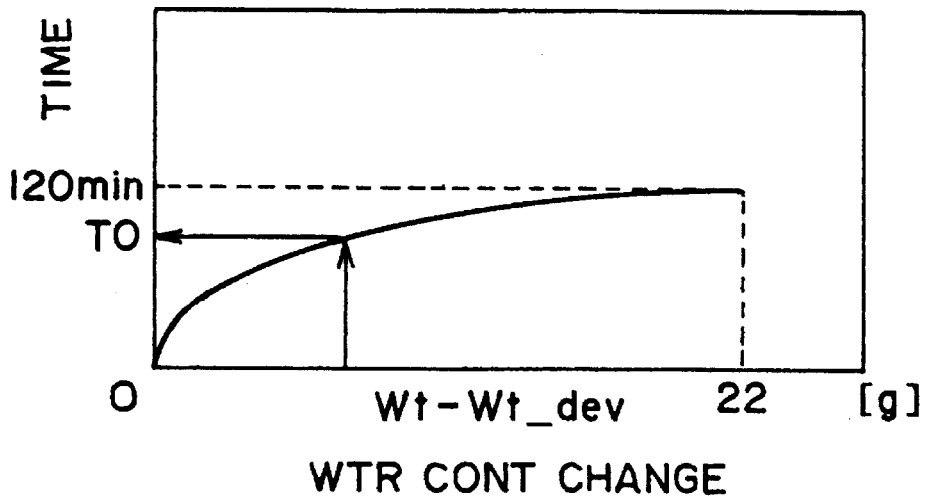
FIGS. 12(*a*) and 12(*b*) are graphs illustrating dependency on the ambient condition change for the toner moisture content converging period.
Figure 12B:
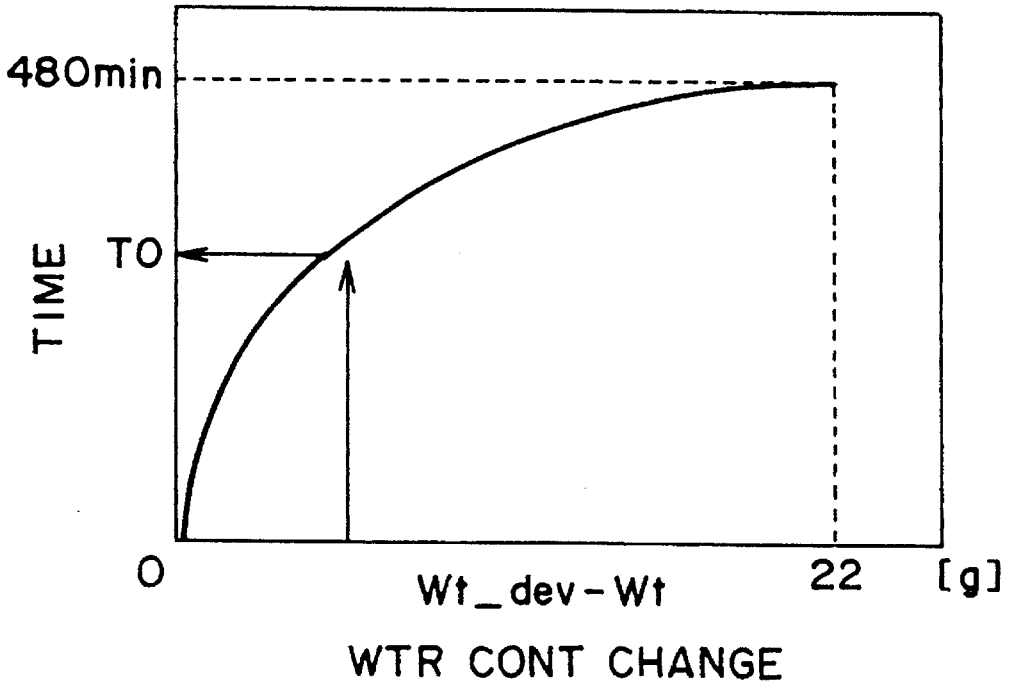

That is, equations (7) and (8) may be used in place of equations (1) and (2), and FIGS. 12(*a*) and 12(*b*) are used in place of FIGS. 7(*a*), 7(*b*).

Here, Wt dev is the initial moisture content of the toner, Wt is the water content obtained by an ambient condition sensor after elapse of ×minutes from the initial state, Wt dev now is the moisture content of the toner predicted as the moisture content after elapse of ×minutes.

(1) Moisture absorbing case, that is, Wt dev≦Wt:

The converging period T0 is determined using FIG. 12(*a*), and the following equation results:

$$Wt\ dev\ \text{now}=[\{Wt\ dev-Wt\}/T0^2]\times(T0-X)^2+Wt \quad (7)$$

where Wt dev now=Wt, when X≧T0

(2) Moisture decreasing case, that is, Wt dev≧Wt:

The converging period T0 is determined using FIG. 12(*b*), and the following equation results:

$$Wt\ dev\ \text{now}=[\{Wt\ dev-Wt\}/T0^2]\times(T0-X)^2+Wt \quad (8)$$

where Wt dev now=Wt, when X≧T0.

As indicated by equations (1) and (2), the moisture or water content of the toner is calculated for each 30 minutes, and X=0.5 is substituted to predict the current toner moisture content.

FIG. 3 is a flow chart of a process in which the charge amount of the toner is sequentially predicted, on the basis of which the optimum contrast voltage Vcont after a predetermined period elapses from the initial state is determined. This is called process A.

A temperature and humidity sensor 101 always takes temperature and humidity data throughout the period in which the electric power is supplied (the main power is in the on-state), and an average is calculated for each 30 minutes, and renew the content of the memory. Then, the absolute water content α is calculated on the basis of temperature and humidity.

Figure 4:
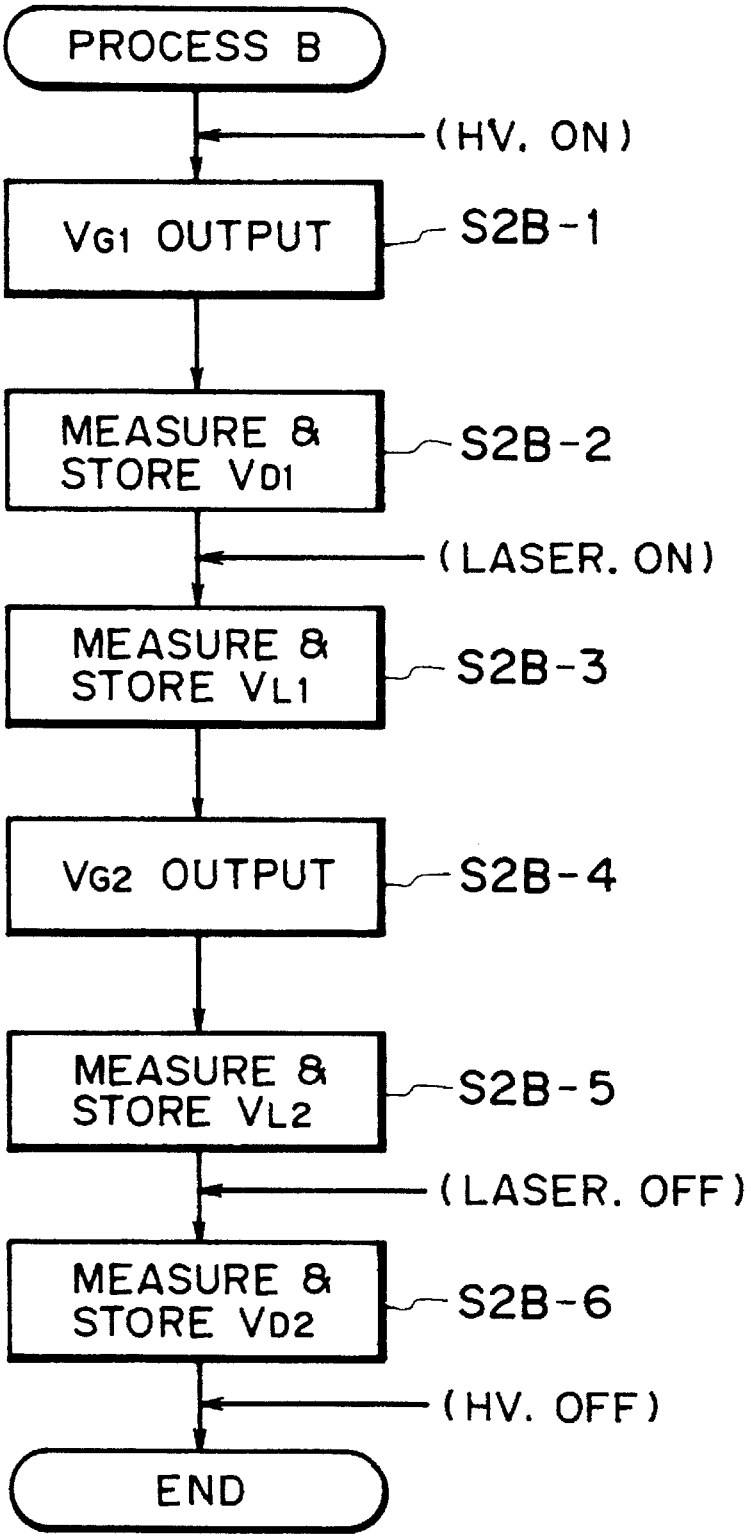
FIG. 4 is a flow chart of a process B for the same calculation.

Then, referring to FIG. 4, a process B will be described. First, the photosensitive drum is rotated as in normal copy sequential operation, and a primary high voltage source 4*a* is actuated. At steps S2B-1, S2B-2, the grid bias voltage of the primary charger 2 is set at a predetermined level VG1, and the surface potential VD1 at the dark portion of the photosensitive drum is measured and stored in memory, respectively. Subsequently, the laser is actuated, to expose the drum to the maximum or a predetermined quantity of light, and at step S2B-3, the light portion surface potential VL1 after the light application is measured and stored in memory. At steps S2B-4, S2B-5, the grid bias voltage is set to another predetermined level VG2, and the light portion surface potential VL2 is measured, respectively. Thereafter, the laser is deactuated or set to a predetermined input level, and at step S2B-6, the dark portion surface potential VD2 is measured and stored in memory. By doing so, the measurement data for the later calculation is obtained. The timing of laser on/off or application of VG1 or VG2 to the grid, may be changed for the purpose of convenience of the sequential operation. The processes A and B are independent, and either may be executed earlier than the other, and in addition, the timings of the executions are not necessarily simultaneous.

Figure 5:
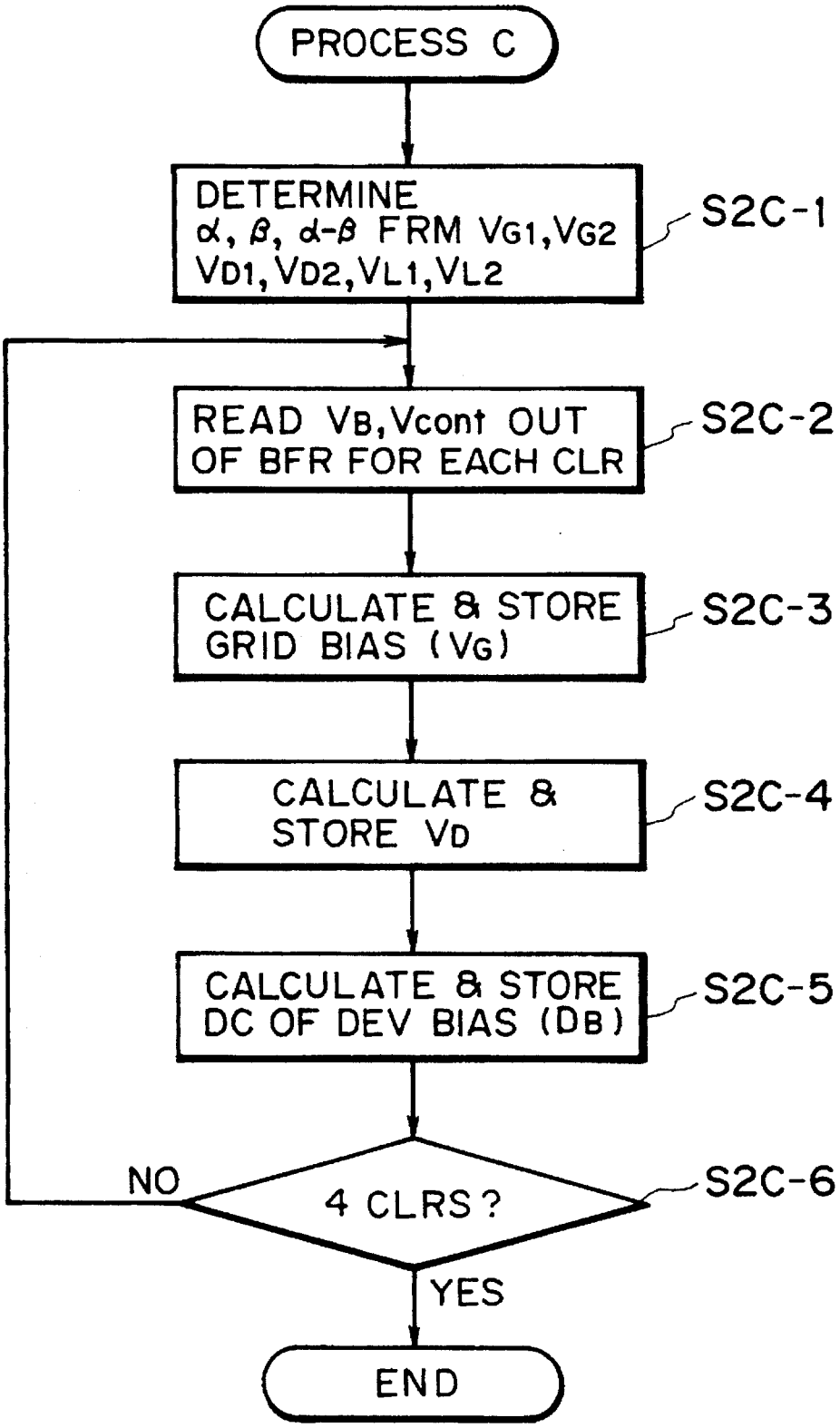
FIG. 5 is a flow chart of a process C for the same calculation.
Figure 10:
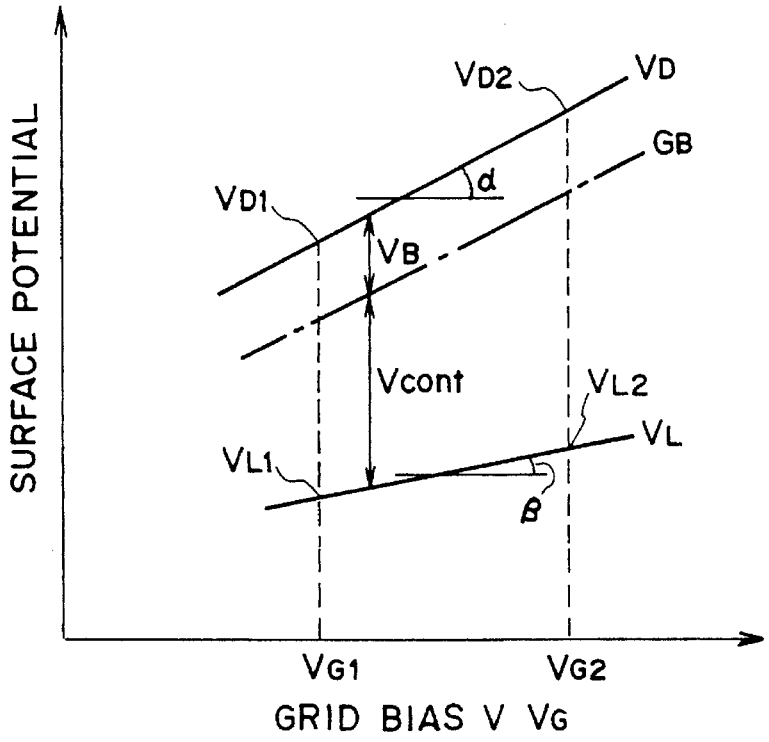
FIG. 10 is a graph schematically showing a potential in the flow chart in FIGS. 4 and 5.

Referring to FIGS. 5 and 10, a process C will be described. The process C has to be carried out after processes A, B are executed.

At step S2C-1, inclinations α and β of a charging curve, and α–β for voltages VD and VL from the voltages VG1 and VG2 and measured data VD1, VD2, VL1 and VL2, in accordance with equation (9):

$$\alpha=(VD2-VD1)/(VG2-VG1),\ \alpha=(VL2-VL1)/(VG2-VG1) \quad (9)$$

Subsequently, at step S2C-2, the fog preventing voltage VB stored in the buffer area and the contrast voltage VcontSALT obtained through process A are read. At step S2C-3, the grid bias voltage VG is calculated by the following equation:

$$VG=[Vcont+VB-(VD1-VL1)]/(\alpha-\beta)+VG1 \quad (10)$$

When the grid voltage is obtained at step S2C-4, VD is obtained by equation (11):

$$VD=\alpha(VG-VG1)+VD1 \quad (11)$$

At step S2C-5, the DC component (DB) of the developing bias voltage is determined through equation (12)

$$DB=VD-VB \quad (12)$$

When the processes are determined as having been completed for the four colors at step S2C-6, the process is finished.

By the above process, the grid bias control voltage VG and the developing bias control DB are obtained.

The grid bias voltage and the developing bias DB have been obtained taking into account not only the humidity condition under which the developer has been placed but also the property of the developer for each color, and therefore, a very stabilized proper density image can be obtained.

In the foregoing, the description has been made in which the ambient condition detecting means detects the humidity. However, the measurement can be effected for another factor influential to the toner, other than the absolute moisture content, temperature or humidity, in response to which the image density is controlled.

In the foregoing embodiment, the description has been made as to the case in which the image forming conditions are determined by the charge potential on the photosensitive drum, the potential after the light application and the developing bias potential, but other conditions such as the charge potential of the developer or toner content in the developer or the like may be used.

The foregoing description has been made with respect to an apparatus capable of forming a multi-color image, but the present invention is not limited to that, and is applicable to a monochromatic image forming apparatus.

In the foregoing, the timing of the detection of the toner patch is mainly after actuation of the main switch after deactuation of the main switch, and before the temperature of the upper roller 9*a* or the lower roller 9*b*. If the time period in which the main switch is kept off is so short that the ambient condition change when the temperature humidity sensor is not operated is not enough to influence the charge amount of the toner, then the patch formation and detection are not necessary. In view of this, the execution of the toner patch reading is determined on the basis of the predicted off period of the fixing heater synchronized with the main switch.

As to the prediction or estimation of the off period of the main switch, another method is usable (for example, off timer). As an alternative, the toner patch may be outputted whenever the main switch is actuated from the off-state.

As to the equation for obtaining the current charge q1 from α1, q0, T0 a two order equation of time is used. This is an approximation on the basis of experiment data. When the conditions regarding the toner triboelectric charge are different, another equation or higher order equation, exponential function or the like are usable.

In the foregoing embodiment, the different tables for the different colors are employed only for the table of FIG. 8. However, the present invention is not limited to this. When the toner property is non-negligibly different for each color, the tables of FIGS. 6 and 7 may be prepared for the respective colors.

In the foregoing embodiment, a toner patch sensor is used as a means for detecting the triboelectric charge amount of the toner in the developing means, but this is not limiting to the present invention. Particularly when two component developer is used, the toner charge is detected by the use of the toner patch sensor and in addition means for detecting toner/carrier ratio, by which the detection accuracy of the triboelectric charge can be enhanced.

The output of the patch detection sensor at the predetermined development contrast is not dependent only on the toner charge. In some cases, it depends on the toner/carrier ratio that is the toner content in effect, in a two component developer. In this case, T/C detecting means for detecting toner/carrier ratio is used to modify the development contrast in response to the output of the T/C detecting means. Examples include reflection ratio measuring means 51, 51*y*, 51*m*, 51*c* in FIG. 1 for measuring reflection ratio of the toner and carrier mixture in the developing device.

Figure 11:
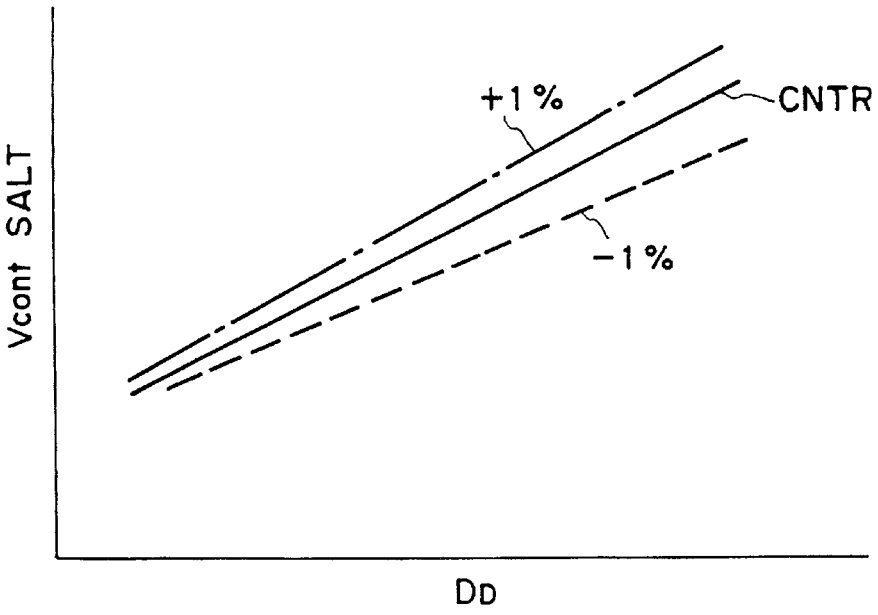
FIG. 11 is a graph of a table used in the optimum contrast potential calculation in the image forming apparatus.

The toner/carrier ratio is called T/C ratio (%), and FIG. 11 shows the dependency of VcontSALT on DD, when the central value is detected and when ±1% is detected.

In the foregoing embodiment, the control of the image forming conditions is effected on the basis of the toner patch detection only when the main switch is changed from off state to on stage, and thereafter, the control is effected on the basis of the ambient condition detection thereafter. However, in addition to the foregoing embodiment, the toner patch is formed and detected for a predetermined period after the main switch is changed from the off state to the on state, and the image forming condition is corrected on the basis of the output of the toner patch sensor at regular intervals. This is a preferable modification because even if the ambient condition is always detected, the estimated toner charge and the actual toner charge are different when the main switch-on period is long. Therefore, if the toner patch sensor output is used at predetermined intervals (for example, every two hours), then the triboelectric charge can be detected more accurately.

As described in the foregoing, when the main power source is changed from off-state to on-state, the image forming conditions are controlled in accordance with an output of a toner charge estimating means, and thereafter, the image forming conditions are controlled in accordance with an output of the ambient condition detecting means, by which an inexpensive image forming apparatus capable of assuring stabilized image quality irrespective of the ambient condition can be provided.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus comprising:

toner image forming means for forming a toner image on a recording material;

fixing means for heat-fixing a toner image on a recording material;

ambient condition detecting means for detecting an ambient condition;

control means for controlling an image forming condition of said image forming means on the basis of an output of said ambient condition detecting means; and second detecting means for detecting a parameter relating to a toner charge amount of a toner image formed on a recording material;

wherein said control means is operable to control an image forming condition on the basis of an output of said second detecting means after a main power source of said image forming apparatus is changed from an off-state to an on-state, and wherein a determination is made as to whether said second detecting means is operated or not, in accordance with a fixing temperature of said fixing means when the main power source is changed from the off-state to the on-state.

2. An apparatus according to claim 1, wherein an ambient condition during an off-state of said main power source is independent of an image forming condition control operation of said control means.

3. An apparatus according to claim 1, wherein said second detecting means detects an image density of a toner patch formed by said toner image forming means.

4. An apparatus according to claim 1, wherein said toner image forming means comprises an image bearing member and transfer means for transferring a toner image from said image bearing member onto a recording material.

5. An apparatus according to claim 4, wherein a toner patch is formed on said image bearing member, and said second detecting means detects an image density of the toner patch.

6. An apparatus according to claim 5, wherein said toner image forming means further comprises developing means for developing an electrostatic image on said image bearing member with a developer, and third detecting means for detecting an amount of toner in said developing means, and wherein said control means controls an image forming condition on the basis of respective outputs of said second detecting means and said third detecting means when the main power source is changed from the off-state to the on-state.

7. An apparatus according to claim 6, wherein said developer includes toner particles and carrier particles.

8. An apparatus according to claim 1, wherein an operation of said second detecting means is prohibited when the fixing temperature is higher than a predetermined level upon a change of the main power source from the off-state to the on-state.

9. An apparatus according to claim 1, wherein said second detecting means detects the parameter of a predetermined period after a change of the main power source from the off-state to the on-state, and wherein said control means controls an image forming condition on the basis of an output of said second detecting means.

10. An apparatus according to claim 1, wherein said toner image forming means comprises an image bearing member, developing means for developing an electrostatic image on said image bearing member with a developer, and wherein said control means controls a bias voltage to be applied to said developing means during a developing operation.

11. An apparatus according to claim 10, wherein said toner image forming means further comprises latent image forming means for forming an electrostatic latent image on said image bearing member, and wherein said control means controls a potential of an electrostatic latent image formed on said image bearing member.

12. An apparatus according to claim 1, wherein said toner image forming means comprises an image bearing member, and latent image forming means for forming an electrostatic latent image on said image bearing member, and wherein said control means controls a potential of an electrostatic latent image formed on said image bearing member.

13. An image forming apparatus comprising:

toner image forming means for forming a toner image on a recording material;

fixing means for heat-fixing a toner image on a recording material;

ambient condition detecting means for detecting an ambient condition;

second detecting means for detecting a parameter relating to a toner charge amount of a toner image formed on a recording material; and control means for controlling an image forming condition of said image forming means on the basis of an output of said ambient condition detecting means;

wherein said control means is operable to control an image forming condition on the basis of an output of said second detecting means after a main power source of said apparatus is changed from an off-state to an on-state, and wherein when the main power source is changed from the off-state to the on-state, a determination is made as to when said second detecting means is operated or not, in accordance with a time period in which said main power source is kept in the off-state.

14. An apparatus according to claim 13, wherein said second detecting means detects an image density of a toner patch formed by said toner image forming means.

15. An apparatus according to claim 13, wherein said toner image forming means comprises an image bearing member and transfer means for transferring a toner image from said image bearing member onto a recording material.

16. An apparatus according to claim 15, wherein a toner patch is formed on said image bearing member, and said second detecting means detects an image density of the toner patch.

17. An apparatus according to claim 16, wherein said toner image forming means further comprises developing means for developing an electrostatic image on said image bearing member with a developer, and third detecting means for detecting an amount of toner in said developing means, and wherein said control means controls an image forming condition on the basis of respective outputs of said second detecting means and said third detecting means when the main power source is changed from the off-state to the on-state.

18. An apparatus according to claim 17, wherein said developer includes toner particles and carrier particles.

19. An apparatus according to claim 13, wherein said second detecting means detects the parameter of a predetermined period after a change of the main power source from the off-state to the on-state, and wherein said control means controls an image forming condition on the basis of an output of said second detecting means.

20. An apparatus according to claim 13, wherein said toner image forming means comprises an image bearing member, developing means for developing an electrostatic image on said image bearing member with a developer, and wherein said control means controls a bias voltage to be applied to said developing means during a developing operation.

21. An apparatus according to claim 13, wherein said toner image forming means comprises an image bearing member, and latent image forming means for forming an electrostatic latent image on said image bearing member, and wherein said control means controls a potential of an electrostatic latent image formed on said image bearing member.

22. An image forming apparatus comprising:

toner image forming means for forming a toner image on a recording material, and for forming a test image;

density detecting means for detecting a density of a test image;

ambient condition detecting means for detecting an ambient condition;

discriminating means for determining a change in the state of the ambient condition on the basis of a plurality of detection results of said ambient condition detecting means; and control means for controlling an image forming condition of said toner image forming means on the basis of an output of said density detecting means and a change in the state of the ambient condition determined by said discriminating means after formation of a test image.

23. An apparatus according to claim 22, wherein the ambient condition detected by said ambient condition detecting means is humidity.

24. An apparatus according to claim 23, wherein said discriminating means determines a speed and direction of change in humidity.

25. An apparatus according to claim 22, wherein a test image is formed after actuation of said main power source of said image forming apparatus.

26. An apparatus according to claim 25, wherein said toner image forming means includes an image fixing member for heating and fixing a toner image on a recording material, and said toner image forming means forms a test image when a temperature of said image fixing member reaches a predetermined level after actuation of the main power source.

27. An apparatus according to claim 22, wherein said toner image forming means forms a half-tone toner image.

28. An apparatus according to claim 22, wherein said ambient condition detecting means detects the ambient condition for every predetermined time period.

* * * * *

UNITED STATES PATENT AND TRADEMARK OFFICE

CERTIFICATE OF CORRECTION

PATENT NO. : 5,550,616 Page 1 of 3

DATED : August 27, 1996

INVENTOR(S) : HISASI FUKUSHIMA

It is certified that error appears in the above-indentified patent and that said Letters Patent is hereby corrected as shown below:

ITEM [57] - ABSTRACT:

Line 2, "material" should read --material,--; and
Line 4, "tion:" should read --tion;--.

COLUMN 1:

Line 56, "of" should be deleted.

COLUMN 2:

Line 17, "a" (second occurrence) should be deleted.

COLUMN 3:

Line 56, "In" should read --In the--.

COLUMN 4:

Line 7, "a" should read --an--;
Line 13, "and" (second occurrence) should be deleted;
Line 20, "at" should read --at a--;
Line 22, "the" (first occurrence) should read --a--;
Line 34, "off-sate" should read --off-state--;
Line 37, "voltages" should read --voltage--; and,
Line 58, "surrounding" should read --surroundings--.

UNITED STATES PATENT AND TRADEMARK OFFICE

CERTIFICATE OF CORRECTION

PATENT NO. : 5,550,616 Page 2 of 3

DATED : August 27, 1996

INVENTOR(S) : HISASI FUKUSHIMA

It is certified that error appears in the above-indentified patent and that said Letters Patent is hereby corrected as shown below:

COLUMN 5:

Line 65, "and is" should read --and α is--.

COLUMN 6:

Line 23, "0.5>T0." should read --0.5>T0,--.
Line 45, "to charge to" should read --to the charge amount--;
Line 49, "obtained" should read --obtained:--;
Line 55, "currents" should read --current--; and,
Line 67, "23°C.5%" should read --23°C. and 5%.--.

COLUMN 7:

Line 2, "t=0.5 thus the following" should read --t=0.5, the following thus--;
Line 15, "xminutes" should read --x minutes--;
Line 17, "xminutes" should read --x minutes--; and,
Line 45, "and renew the content of the memory." should read --and the content of the memory renewed.--.

UNITED STATES PATENT AND TRADEMARK OFFICE

CERTIFICATE OF CORRECTION

PATENT NO. : 5,550,616

DATED : August 27, 1996

INVENTOR(S) : HISASI FUKUSHIMA

It is certified that error appears in the above-indentified patent and that said Letters Patent is hereby corrected as shown below:

COLUMN 8:

Line 26, "(12)" should read --(12):--.

COLUMN 9:

Line 12, "are" should read --is--;
Line 43, "stage," should read --state,--; and,
Line 44, "thereafter" should be deleted.

Signed and Sealed this

Twenty-fifth Day of March, 1997

*Attest:*

*Attesting Officer*

BRUCE LEHMAN

*Commissioner of Patents and Trademarks*